US007896090B2

(12) United States Patent
Storey et al.

(10) Patent No.: US 7,896,090 B2
(45) Date of Patent: Mar. 1, 2011

(54) STROKING TOOL USING AT LEAST ONE PACKER CUP

(75) Inventors: Bryan T. Storey, Spring, TX (US); Mark K. Adam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 30 days.

(21) Appl. No.: 12/412,042

(22) Filed: Mar. 26, 2009

(65) Prior Publication Data

US 2010/0243237 A1 Sep. 30, 2010

(51) Int. Cl.
*E21B 33/126* (2006.01)
*E21B 17/07* (2006.01)

(52) U.S. Cl. ..... 166/387; 166/381; 166/202; 166/242.7

(58) Field of Classification Search ..... 166/242.7, 166/381, 387, 202
See application file for complete search history.

(56) References Cited

U.S. PATENT DOCUMENTS 3,354,950 A * 11/1967 Hyde ..... 166/336
4,295,524 A * 10/1981 Baker et al. ..... 166/278
4,391,325 A * 7/1983 Baker et al. ..... 166/208
4,693,316 A * 9/1987 Ringgenberg et al. ..... 166/355
4,961,465 A * 10/1990 Brandell ..... 166/184
5,553,672 A * 9/1996 Smith et al. ..... 166/382
5,690,172 A * 11/1997 Westra ..... 166/123
5,957,198 A * 9/1999 Haynes ..... 166/250.03
6,009,943 A * 1/2000 Yokley et al. ..... 166/125
6,070,670 A * 6/2000 Carter et al. ..... 166/381
6,098,713 A * 8/2000 Ross ..... 166/297
6,131,662 A * 10/2000 Ross ..... 166/369
6,189,621 B1 2/2001 Vail, III
6,367,552 B1 * 4/2002 Scott et al. ..... 166/355
6,540,025 B2 * 4/2003 Scott et al. ..... 166/355
7,066,264 B2 * 6/2006 Bissonnette et al. ..... 166/305.1
7,121,351 B2 * 10/2006 Luke et al. ..... 166/382
7,140,428 B2 * 11/2006 Campo ..... 166/55
7,316,274 B2 * 1/2008 Xu et al. ..... 166/285
7,708,076 B2 * 5/2010 Richard et al. ..... 166/377
2002/0092653 A1 * 7/2002 Scott et al. ..... 166/338
2005/0098313 A1 * 5/2005 Atkins et al. ..... 166/202
2006/0096762 A1 * 5/2006 Brisco ..... 166/384

(Continued)

OTHER PUBLICATIONS

Baker Oil Tools, "Hydraulic Setting Tool for Top Set Packers", Product Family H26534, Nov. 2004, 2 pages.

(Continued)

*Primary Examiner*—Jennifer H Gay
(74) *Attorney, Agent, or Firm*—Steve Rosenblatt

(57) ABSTRACT

A tool for subterranean use employs relative movement between a housing and a piston by pressurizing and removing pressure in a variable volume defined between them. The variable volume is sealed with packer cups preferably with one supported from the piston and the other off the housing and in opposed orientations so that the broad surface area on each packer cup abuts the surface where relative movement takes place. The downhole tasks accomplished with the relative movement can be varied and include tubular expansion, setting packers or shifting sleeves, for example. A single or multiple packer cups are tied to a structure that needs to be driven and building pressure behind a packer cup or reducing pressure ahead of it advance the piston.

21 Claims, 1 Drawing Sheet

U.S. PATENT DOCUMENTS

| | | | | |
|---|---|---|---|---|
| 2009/0101345 | A1* | 4/2009 | Moffitt et al. | 166/285 |
| 2009/0277627 | A1* | 11/2009 | Dallas | 166/85.1 |
| 2010/0243237 | A1* | 9/2010 | Storey et al. | 166/202 |

OTHER PUBLICATIONS

Baker Oil Tools, "Linexx Hudraulic Expansion Tool" Jan. 2006, 2 pages.

Strafiotti, Stephen, et al., "Successful Milling and Removal of a Permanent Bridge Plug with Electric-Line Tractor-Conveyed Technology", SPE 121539, Mar. 2009, 1-7.

Broussard, John, et al., "Multizonal Isolation Technology for Injection Testing and Stimulation Treatments", SPE 91452, Sep. 2004, 1-10.

Porteous, W.R, et al., "An Economical Method of Rapid Reservoir Testing", SPE 289, Journal of Petroleum Technology, Sep. 1962, 957-961.

* cited by examiner

STROKING TOOL USING AT LEAST ONE PACKER CUP

FIELD OF THE INVENTION

The field of this invention is downhole tools of the type that extend a piston in response to pressurizing an annular space and more particularly where the space is sealed with a packer cup.

BACKGROUND OF THE INVENTION

In a subterranean environment the expansion of tubulars frequently requires force applied to a swage that cannot be delivered through the surface equipment. To accomplish such expansions an assembly of tools has been used that has a swage at the lower end and a resettable anchor at the upper end. In between is a stroking tool. Applying pressure in a string that supports this assembly first sets the anchor and then pressurizes an annular chamber between a housing and a piston that is inside it. The annular space is sealed with end seals between the relatively movable components. The swage is secured to the movable piston. Extension of the piston drives the swage through the tubular. If the expansion is top down, at the end of the piston stroke the applied pressure in the running string is removed and weight is set down. Removal of the internal pressure in the running string allows the anchor to collapse so that the set down weight acts to bring the housing back over the extended piston. This re-cocks the piston for a repeat of the previous cycle until the swage is driven as far through the tubular as the application requires.

Such stroking tools as used by Baker Oil Tools for its LinEXX Hydraulic Expansion System have used stacks of chevron seals to seal the variable volume annular space that drives the piston. The problem with sealing with the chevron seal stacks is the expensive surface preparation of the moving surface that goes past the seals. In some versions the contact surface was chrome plated after an expensive surface cleaning operation to remove burrs and other surface irregularities. In some instances the piston was a machined part adding to the product cost.

Other stroking tools such as the Hydraulic Setting Tool for Top Set Packers sold by Baker Oil Tools under Product Family H26534 used an annular variable volume cavity whose ends were sealed with o-ring seals. Depending on the cleanliness of the pressurizing fluid, the service life of the o-ring seals could be significantly reduced.

U.S. Pat. No. 6,189,621 illustrates the use a downhole shuttle device with a peripheral seal and an onboard pump so that operation of the pump pulls suction ahead of the seal on the shuttle and the pump discharge goes uphole of the barrier seal so as to propel the shuttle in the downhole direction.

In a new design with an objective of reducing constructed cost while maintaining or enhancing service life, the preferred embodiment of the present invention seeks to create a variable volume space with lower cost components some of which are readily commercially available. At least one packer cup is deployed to seal the variable volume space during piston extension. Preferably, the opposed ends of the variable volume space are sealed with packer cups whose orientation puts the broad surface area of the cup against the surface where relative movement occurs. In alternative embodiments the packer cup can be used to drive a string in the wellbore. Alternate applications are envisioned beyond stroking a swage to expand a tubular.

SUMMARY OF THE INVENTION

A tool for subterranean use envisions relative movement between a housing and a piston by pressurizing and removing pressure in a variable volume defined between them. The variable volume is sealed with packer cups preferably with one supported from the piston and the other off the housing and in opposed orientations so that the broad surface area on each packer cup abuts the surface where relative movement takes place. The downhole tasks accomplished with the relative movement can be varied and include tubular expansion, setting packers or shifting sleeves, for example. Alternative embodiments envision use of a single or multiple packer cups tied to a structure that needs to be driven and building pressure behind a packer cup or reducing pressure ahead of it to advance it.

DETAILED DESCRIPTION OF THE PREFERRED EMBODIMENT

Figure 1:
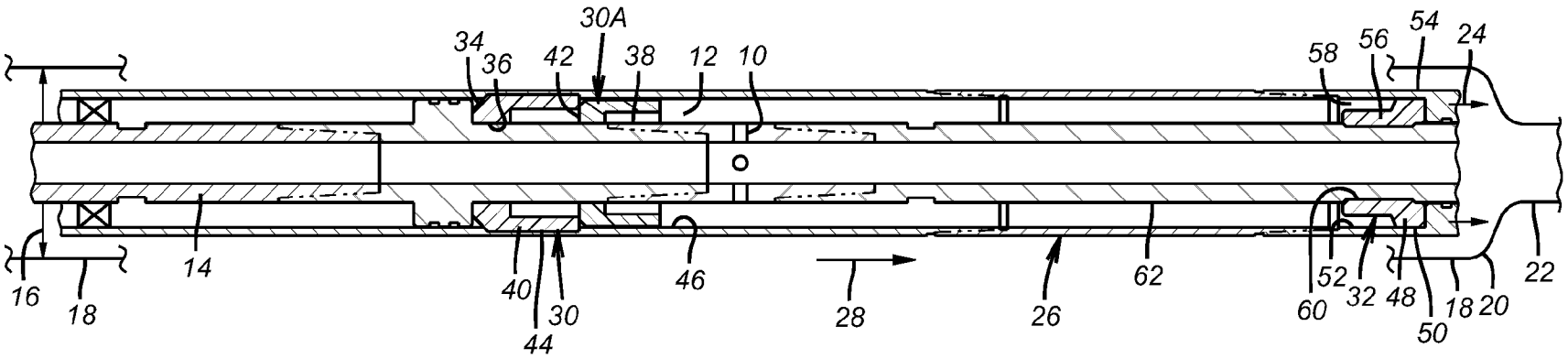
FIG. 1 is a section view of a stroker using two packer cups.

FIG. 1 illustrates how the relative movement is generated with applied pressure to ports 10 leading to a variable volume cavity 12. A tubular string 14 has an anchor schematically illustrated by arrow 16 for selective grip on an existing tubular string 18 shown discontinuously at opposed ends of FIG. 1. String 18 has a taper 20 leading to a smaller diameter section 22 to be expanded. Arrows 24 represent a swage secured to a lower end of a piston assembly 26. The piston assembly 26 is movable with respect to string 14 which acts as a stationary mandrel when anchored to the tubular string 18 at anchor 16. In the view of FIG. 1 the assembly 26 has been propelled downhole to the fullest extent with respect to the mandrel 14 that is needed to define the variable volume cavity 12. A travel stop (not shown) can be used to limit the movement of the assembly 26 in the direction of arrow 28 with respect to mandrel 14. After the position of FIG. 1 is reached, the pressure in the mandrel 14 is removed to release the anchor 16 and weight is set down from the surface. Assembly 26 stays put as the mandrel 14 with the packer cup 30 move in tandem toward the now stationary assembly 26 and packer cup 32 that is attached to it. This happens because the weight of assembly 26 is resting on progressively moving taper 20 whose location changes with each stroke of assembly 26.

Looking specifically at the orientation of packer cups 30 and 32 it can be seen that the packer cup 30 has a neck 34 that includes a bore 36 that abuts the mandrel outside diameter 38. As used herein, the terms "packer cup" or "cup" or "cup seal" or "exterior opening skirt type cup" are intended to encompass a variety of shapes that include an opening and experience an enhancement of seal contact force when pressure is applied in the opening. Thus the illustrated "L" shapes are envisioned as well as other shapes such as, for example, "U" or "V" shapes. There can be an o-ring in bore 36 to seal against surface 38. There is no relative movement between the packer cup 30 and the surface 38 so an o-ring seal is satisfactory in that location. The packer cup 30 further has a downhole oriented skirt 40 having a lower end opening 42 looking in the downhole direction of arrow 28. The large outer surface 44 of the skirt 40 is in contact with the moving inside surface 46 of the assembly 26.

Those skilled in the art comparing packer cups 30 and 32 will notice that cup 32is oriented as a mirror image of cup 30 and is further turned inside out in comparison to cup 30. Neck 48 has an outer sealing surface 50 that abuts inside surface 52 of bottom sub 54 of assembly 26. An o-ring seal (not shown) can span surfaces 50 and 52 and is preferably put into a groove (not shown) in surface 50. The skirt 56 has an open end 58 oriented uphole in the opposite direction from arrow 28. The skirt 56 has an inner surface 60 that contacts the outer surface 62 of the mandrel 14.

Those skilled in the art will appreciate that pressure applied through ports 10 to variable volume cavity 12 will go into the open areas defined by ends 42 and 58 so as to push the skirt 40 and its outer surface 44 against surface 46 of the assembly 26 as the assembly 26 moves relatively as the volume of chamber 12 increases. Similarly, pressure into opening 58 pushes surface 60 of skirt 56 into the outside surface of 62 of assembly 26. By putting the largest surface area of a given skirt against a relatively moving surface the sealing quality is greatly improved without expensive surface preparation. Surfaces 46 and 62 can have a cursory pass to blast grit and the skirts in the configurations illustrated should provide reliable sealing for a reasonable service life without issues of leakage.

While the design in FIG. 1 is the preferred embodiment, other variations are contemplated. The cup seal can be used at on only one end. Multiple seals 30 or 32 with the same orientation on a given end, such as 30A, can be used to back each other up so that if one is damaged an adjacent one can take its place so that the seal is not lost. The size of the skirts on either of the seals can be larger than the diameter of surface 46 as in the case of seal 30 or smaller than the outside diameter 62 in the case of seal 32 so that in either or both cases there is an interference fit on assembly. The material choice for the seals 30 and 32 has to be compatible with the well conditions and the expected number of cycles during a reasonable service life. The seals have to withstand the delivered pressure differentials and can have inserts in the skirts to provide an assist to sealing beyond the initial interference fit referred to above. The inserts can be in the form of metallic or composite bands or by using blends of different materials such as rubber of different grades to resist hoop stresses from differential pressure loading. The inserts can be axially oriented or in the form of rings 64 and 66 (shown in FIG. 2) among other possible shapes.

Figure 2:
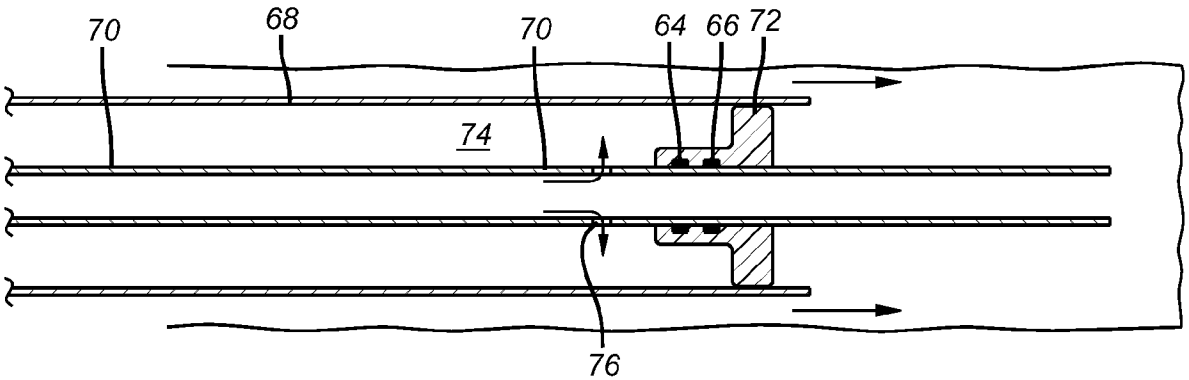
FIG. 2 is a system where a packer cup can be used to drive a tubular string into a wellbore.

Referring to FIG. 2, a tubular string 68 is delivered on a string 70 with a cup seal 72 closing off the lower end of annular space 74. Openings 76 allow access to pressurize space 74 from within the string 70. String 70 can support string 68 for delivery to a specific location. If the outer string 68 gets difficult to advance in tandem with string 70 the two strings can be decoupled to allow relative movement between them and pressure applied to string 70 can advance string 68 relative to it within predetermined travel limits. Through a series of pressuring cycles followed by removal of pressure and setting down weight on string 70, string 70 can continue to be a guide to string 68. Clearly the two strings would be still secured to each other within limits of relative movement so that they would not fully detach when string 68 is powered by pressure delivered at ports 76. This is but an example of how a single packer cup or a plurality of packer cups oriented the same way can be used to create relative motion of downhole components to accomplish a given task. The string 68 once properly placed and supported can be released from the run in string 70 for removal of string 70 with cup seal or seals 72.

It should be noted that the relationship between what has been described as the stationary member and the moved member can be reversed. In the FIG. 1 embodiment, for example, the assembly 26 can be selectively anchored and the mandrel 14 can be secured to a swage such as 24. The packer cups 30 and 32 will be oriented differently so that their respective skirts 40 and 56 are up against a surface where relative movement occurs.

The above description is illustrative of the preferred embodiment and many modifications may be made by those skilled in the art without departing from the invention whose scope is to be determined from the literal and equivalent scope of the claims below.

We claim:

1. A tool for performing a subterranean task, comprising:

a movable member and a stationary member nested together and defining an annular space therebetween;

at least two spaced apart cup seals to close said annular space between said members to allow pressure buildup in said annular space to create relative movement between said movable and said stationary members a first skirt opening of one of said at least two spaced apart cup seals is interior to a first skirt forming said first opening and a second skirt opening of the other of said at least two spaced apart cup seals is exterior to a second skirt forming said second opening.

2. The tool of claim 1, wherein:

said at least one cup seal mounted to one of said movable and said stationary members and having a skirt in contact with the other of said movable and said stationary members.

3. The tool of claim 2, wherein:

said at least one cup seal is mounted to the movable member.

4. The tool of claim 2, wherein:

said at least one cup seal comprises a plurality of spaced apart cup seals that define said annular space whose volume changes with said relative movement of said members.

5. The tool of claim 4, wherein:

said plurality of spaced apart cup seals comprises at least two identically oriented cup seals are disposed in a spaced relation to define at least one end of said annular space.

6. The tool of claim 4, wherein:

at least two of the plurality of spaced apart cup seals each having skirt openings facing each other.

7. The tool of claim 4, wherein:

at least one of said plurality of spaced apart cup seals comprises reinforcement.

8. The tool of claim 7, wherein:

said reinforcement is internal to said skirt.

9. The tool of claim 8, wherein:

said reinforcement has a ring shape.

10. The tool of claim 1, wherein:

said movable member further comprises a swage.

11. The tool of claim 1, wherein:

said at least one cup seal, in cross-section has an "L" or "U" or "V" shape.

12. A tool for performing a subterranean task, comprising:

a movable member and a stationary member nested together and defining an annular space therebetween;

at least one cup seal to close said annular space between said members to allow pressure buildup in said annular space to create relative movement between said movable and said stationary members;

said at least one cup seal mounted to one of said movable and said stationary members and having a skirt in contact with the other of said movable and said stationary members;

said at least one cup seal is mounted to the stationary member.

13. A tool for performing a subterranean task, comprising:

a movable member and a stationary member nested together and defining an annular space therebetween;

at least one cup seal to close said annular space between said members to allow pressure buildup in said annular space to create relative movement between said movable and said stationary members;

said at least one cup seal mounted to one of said movable and said stationary members and having a skirt in contact with the other of said movable and said stationary members;

said at least one cup seal comprises a plurality of spaced apart cup seals that define said annular space whose volume changes with said relative movement of said members;

at least two of the plurality of spaced apart cup seals each having skirt openings facing each other;

said skirt opening of one of said at least two spaced apart cup seals is interior to a skirt forming said opening and said skirt opening of the other of said at least two spaced apart cup seals is exterior to a skirt forming said opening.

14. The tool of claim 13, wherein:

said stationary member is inside said movable member and said stationary member has at least one port to communicate pressure to said annular space defined between spaced apart cup seals.

15. The tool of claim 14, wherein:

said stationary member is selectively anchored with a hydraulically actuated anchor through a fluid passage in said stationary member that is also in fluid communication with said port.

16. The tool of claim 15, wherein:

said movable member is cycled for extension with respect to said stationary member with cyclical application and removal of pressure in said passage with setting down weight on said stationary member when said anchor is released upon removal of pressure.

17. The tool of claim 16, wherein:

said movable member further comprises a swage adjacent an end thereof.

18. The tool of claim 17, wherein:

at least one cup seal of said plurality of spaced apart cup seals comprises reinforcement.

19. The tool of claim 18, wherein:

said reinforcement is ring shaped and internal to said skirt.

20. A tool for performing a subterranean task, comprising:

a movable member and a stationary member nested together and defining an annular space therebetween;

at least one cup seal to close said annular space between said members to allow pressure buildup in said annular space to create relative movement between said movable and said stationary members;

said stationary member is a run in string and said movable member is a casing or liner string, wherein relative movement advances said casing or liner string in a subterranean direction.

21. The tool of claim 20, wherein:

said at least one cup seal further comprises an exterior opening skirt type cup.

* * * * *